United States Patent [19]

Sieffert

[11] 4,114,757

[45] Sep. 19, 1978

[54] BOOK CARTON

[75] Inventor: William G. Sieffert, Joliet, Ill.

[73] Assignee: Champion International Corporation, Stamford, Conn.

[21] Appl. No.: 840,559

[22] Filed: Oct. 11, 1977

[51] Int. Cl.[2] ..... B65D 85/30
[52] U.S. Cl. ..... 206/424; 229/40
[58] Field of Search ..... 206/424, 521, 491, 492; 229/40

[56] References Cited

U.S. PATENT DOCUMENTS

| | | | |
|---|---|---|---|
| Re. 28,460 | 7/1975 | Rous | 206/424 |
| 3,768,721 | 10/1973 | Carpenter et al. | 229/40 |
| 3,985,230 | 10/1976 | Meyer et al. | 206/424 |
| 3,986,608 | 10/1976 | Rous | 206/424 |
| 3,989,141 | 11/1976 | Rous | 206/424 |

*Primary Examiner*—Stephen P. Garbe
*Attorney, Agent, or Firm*—Evelyn M. Sommer

[57] ABSTRACT

A carton for shipping books having a simplified end cell configuration to protect the edges of the book during shipment and storage and glue flaps which can be glued against the upper surface of the carton using conventional packaging machinery.

2 Claims, 4 Drawing Figures

BOOK CARTON

BACKGROUND OF THE INVENTION

This invention relates generally to cartons for shipping and storing books and more particularly to a carton having a protective end cell configuration and glue flaps which permit the carton to be sealed using conventional packaging apparatus.

Individual sales of books and mailing of those orders is wide-spread and it is therefor necessary to have a mailing carton which will protect the book during shipment. The package typically consists of a single book or a relatively small number of books with the result being that the thickness of the package is substantially less than its width or length. The possibility of shipping damage to the edges of hard bound books is a factor in the design of the carton for shipping those books. Elaborate end-cell configurations are available in the art but those configurations increase the cost since they can not be readily processed by high speed automatic packaging equipment, but instead must be processed by hand at greater cost. Also, elaborate end-cell configurations employ more material than would otherwise be desirable. What is therefore needed is a simple construction which may be used on automatic equipment yet which provides sufficient protection for the edges of the carton.

One known mailing carton which satisfied the requirement for a simple and inexpensive construction was made from a blank having a rectangular bottom panel having first and second end wall panels connected by vertical fold lines at first and second edges of the bottom panel. This carton included a rectangular top panel which was as wide as but shorter than the bottom panel. The end wall panels at either edge of the bottom panel were tapered inwardly. The top and bottom edges of both the top and bottom panels included side wall flaps connected to the panels along fold lines. A single glue flap extended from the end wall panel secured to the bottom panel opposite the end wall connecting the top and bottom panel. When the carton was folded, the single glue flap could be glued against the surface of the top panel. The side panel flaps of the bottom panel were brought into contact with the side panel flaps of the top panel at an angle (i.e., the outer surface of a wedge) to the top and bottom panels. Since these flaps lay in a different plane form the single glue flap, they had to be glued in a separate manual operation or using special packaging apparatus.

SUMMARY OF THE INVENTION

A blank for manufacturing a book carton made in accordance with the present invention includes a rectangular bottom panel which is joined to a rectangular top panel by a first end panel. The top panel is the same width as the bottom panel but is shorter. That is, the top and bottom edges of the top panel are spaced inwardly from the top and bottom edges of the bottom panel. The upper and lower edges of the first end panel and of a second end panel on the opposite side of the bottom panel are tapered inwardly. Both the top and the bottom panels have side flaps connected to the upper and lower edges along fold lines. Glue flaps extend from the second end panel and from the side flaps at the upper and lower edges of the bottom panel. When the blank is folded into the book carton, the end glue flap and side glue flaps can be glued directly to the outer surface of the top panel. Since all of the glue flaps lay in the same plane, the glueing can be completed in a single step with conventional packaging apparatus. The side glue flaps enhance the integrity of the end cell configuration formed upon folding since they provide added glue area.

DETAILED DESCRIPTION OF THE PREFERRED EMBODIMENT

Figure 3:
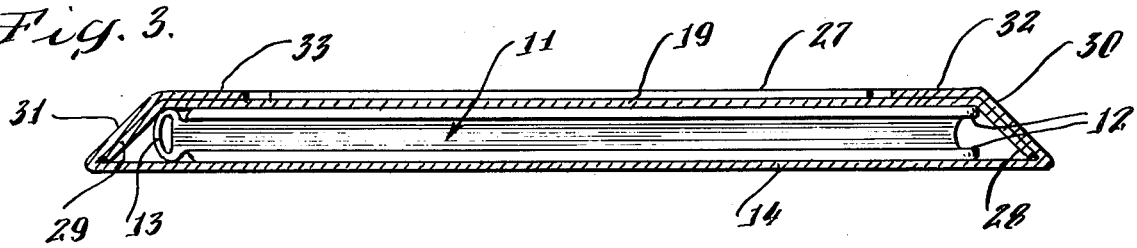
FIG. 3 is a side elevation section view taken along section lines 3—3 in FIG. 1.
Figure 4:
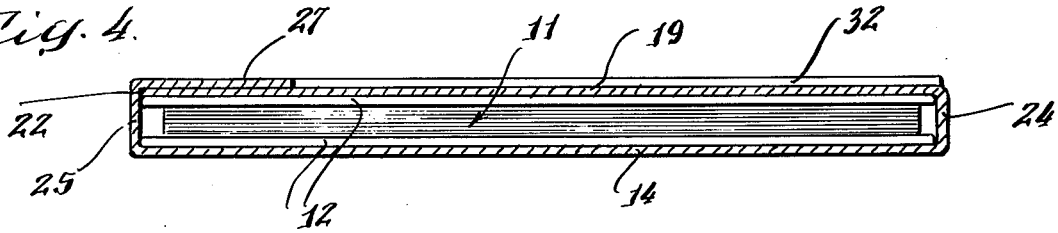
FIG. 4 is a sectional elevation view of the carton shown in FIG. 1 taken along section lines 4—4 of that figure.

The present invention protects single books during shipment or stacks of books where the stack is relatively thin in respect to its width and length. A folded carton is shown generally as 10 in FIG. 1 for a single book. As can be seen in FIGS. 3 and 4, a book 11 may be a hard cover volume with covers 12 and a back or binding 13.

Figure 1:
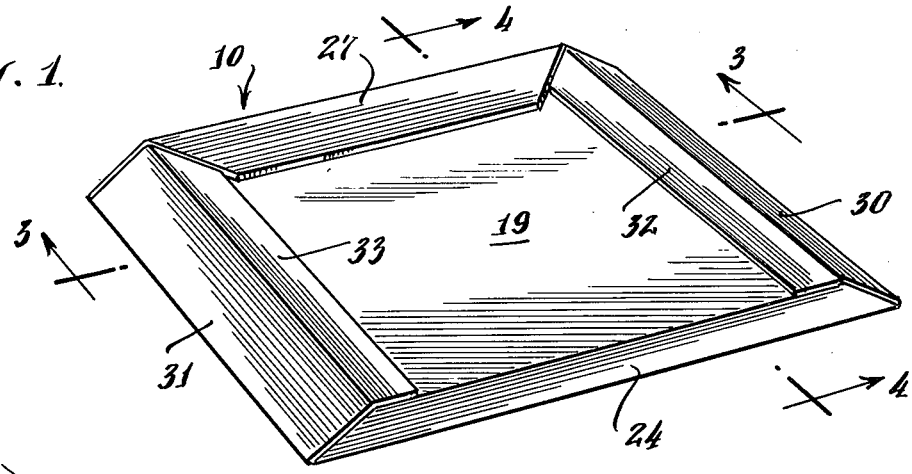
FIG. 1 is a perspective view of an assembled package embodying the present invention.
Figure 2:
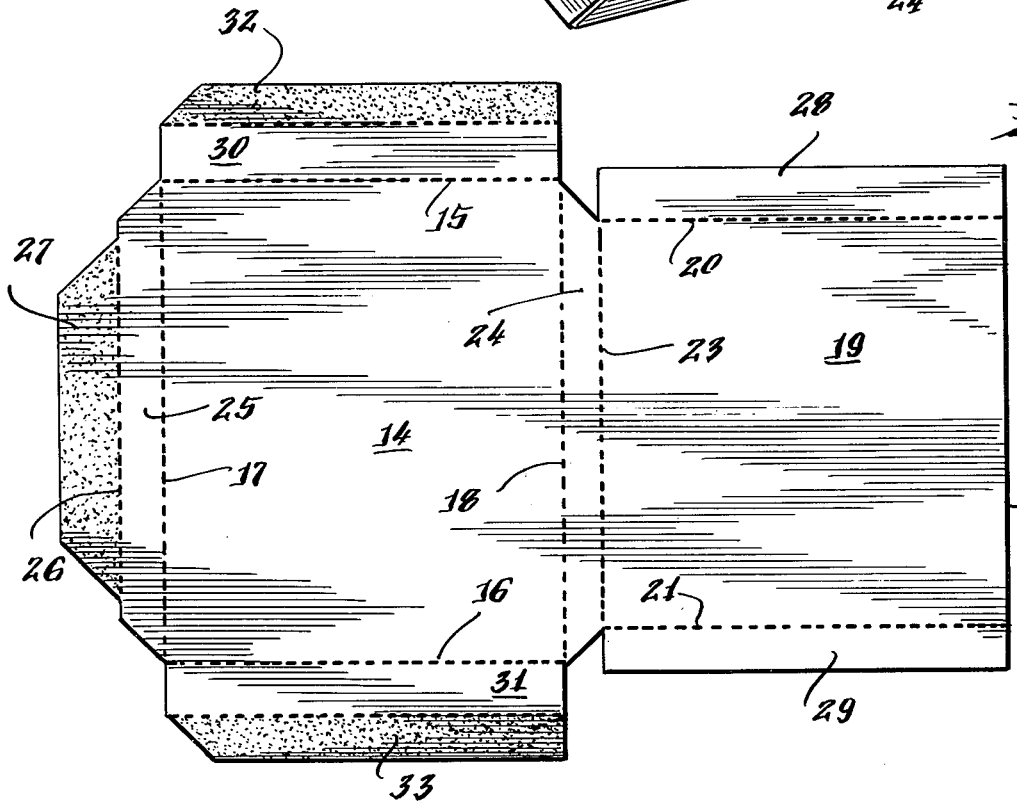
FIG. 2 is a plan view of a blank adapted to be erected into a carton similar to that shown in FIG. 1.

The blank shown in FIG. 2 is made of a substantially flat sheet of rigid sheet-like material such as corrugated paperboard or the like, and may be erected into a carbon 10 such as shown in FIG. 1. The blank includes a bottom panel 14 which is substantially rectangular in shape and is defined by top and bottom horizontal fold lines 15 and 16 respectively. The bottom panel 14 is further defined by a pair of vertical spaced-apart fold lines 17 and 18 which define the two lateral edges of the bottom panel 14.

Positioned adjaent to the bottom panel 14 is a top panel 19 which is also rectangular in shape and is defined on its top and bottom edges by a pair of horizontally aligned fold lines 20 and 21. The horizontal fold lines 20 and 21 are spaced apart a distance less than the spacing of the two horizontal lines 15 and 16. The distance between the horizontal fold lines 20 and 21 is substantially equal to one dimension of the book 11. The top panel 19 is defined laterally by a first outside edge 22 and a second lateral edge 23 which is a vertical fold line positioned parallel to the outside lateral edge 22 and which, along with the vertical fold line 18, serves to connect the bottom and top panels 14 and 19 with and to a first end panel 24. On the opposite side of the bottom panel 14 and connected along the vertical edge by a vertical fold line 26 and attached thereto is a first manufacturer's glue flap 27 which has tapered edges connecting it to the end panel 25. It should be noted that the top and bottom edges of the end panels 24 and 25 are also angled diagonally to provide proper alignment in the final folded position between the top and bottom edges of the top and bottom panels 14 and 19, since the edges of the top panel 19 lie inwardly of the top and bottom edges of the bottom panel 14.

The top edges of the top panel 19 have attached thereto inner side panel flaps 28 and 29 which are designed to lie at a diagonal or angular relationship to the top and bottom panels 19 and 14 in the final configuration as may be seen best in FIG. 3. Along the top and bottom edges of the bottom panel 14 are attached outer side panel flaps 30 and 31, which as may be seen in FIG. 3 lie on the outside of the side walls and also lie at an angle to form the wedge of air cell which runs along the length of the sides of the book 11.

A second glue flap 32 is connected to the outer horizontal edge of side panel flap 30 at a fold line. While the right edge of this glue flap 32 is a continuation of the right edge of side panel flap 30, the left edge of the glue flap is cut at an angle. This angled edge prevents any overlap between this glue flap and glue flap 27 when the carton is folded. A third glue flap 33, which is a mirror image of glue flap 32, extends outwardly from the edge of side panel flap 31.

The glue flaps 27, 32, 33, which can be secured to the surface of top panel 19 in a single pass through a packaging apparatus, securely fasten side panel flaps 30 and 31 in place to maintain the integrity of the end cell configuration during shipping.

I claim:

1. A blank made of foldable paperboard or similar sheetlike material adapted to be erected into a book carton, comprising:

a rectangular bottom panel having horizontal top and bottom edges and vertical lateral side edges, said top and bottom edges defining a lengthwise dimension in the carton to be erected, said length being greater than the corresponding dimension of the book to be contained in said carton;

a first end wall panel connected by a vertical fold line along a first lateral edge of said bottom panel;

a second end wall panel connected by a vertical fold line along a second lateral edge of said bottom panel;

a rectangular top panel having horizontal top and bottom edges and vertical lateral side edges, said top and bottom edges of said top panel defining a lengthwise dimension less than the length of said bottom panel but at least as great as the length of the book to be contained in the carton, said top and bottom edges of said top panel being spaced inwardly from said top and bottom edges of said botton panel a predetermined distance;

said end walls having top and bottom edges angled away from the lateral ends of said top and bottom edges of said bottom panel and terminating at the level of said top and bottom edges of said top panel;

said top and bottom edges of said top and bottom panels each having side wall flaps hingedly connected thereto;

a first manufacturer's glue flap hingedly connected along one lateral edge of said blank, the top and bottom edges of said first glue flap tapering from said second end wall to the free edges of said first glue flap; and second and third manufacturer's glue flaps connected along opposite horizontal edges of said blank adjacent said first glue flap.

2. A container for books or the like made from foldable paperboard or similar sheet-like material, comprising:

a rectangular bottom panel having parallel top and bottom edges defining a lengthwise dimension in said container, said length being greater than the corresponding dimension of a book to be contained therein;

a rectangular top panel positioned parallel to said bottom panel and having a corresponding lengthwise dimension less than said length of said bottom panel but at least as great as the length of a book to be contained therein;

said top and bottom panels connected by end walls perpendicular thereto having diagonally cut edges extending between the respective edges of said top and bottom panels;

side walls positioned adjacent to and connecting the respective top and bottom edges of said top and bottom panels and positioned obliquely thereto; and glue flaps extending from said sidewalls and from one of said end walls, said glue flaps overlying and being secured to a portion of the top panel.

* * * * *